United States Patent [19]

Commisso

[11] 3,955,710

[45] May 11, 1976

[54] COVERED CONTAINER FOR SERVING FOOD WITH COMBINATION VENTILATION AND FINGER HOLES

[75] Inventor: Nicholas D. Commisso, Victor, N.Y.

[73] Assignee: Mobil Oil Corporation, New York, N.Y.

[22] Filed: June 3, 1974

[21] Appl. No.: 475,735

[52] U.S. Cl. ..... 220/367; 150/.5; 220/306; 229/2.5 R

[51] Int. Cl.[2] ..... B65D 51/16

[58] Field of Search ..... 206/508, 815; 229/2.5; 220/306, 352 B, 356, 367; 150/.5

[56] References Cited

UNITED STATES PATENTS

| | | | |
|---|---|---|---|
| 2,304,912 | 12/1942 | Henchert | 206/508 |
| 2,585,180 | 2/1952 | Smith | 220/356 |
| 2,899,096 | 8/1959 | Henchert et al. | 206/508 |
| 3,154,827 | 11/1964 | Gentry | 206/815 |
| 3,349,950 | 10/1967 | Wanderer | 229/1.5 B |
| 3,387,765 | 6/1968 | Davis | 220/367 |
| 3,448,912 | 6/1969 | Arnosky et al. | 229/1.5 B |
| 3,768,689 | 10/1973 | Gauthier, Jr. | 220/356 |
| 3,815,736 | 6/1974 | Sedlak | 229/2.5 |
| 3,820,685 | 6/1974 | Reisman | 229/5.6 |

*Primary Examiner*—William Price
*Assistant Examiner*—Bruce H. Bernstein
*Attorney, Agent, or Firm*—Charles A. Huggett; James D. Tierney

[57] ABSTRACT

A thin gauge plastic cover having a downwardly depending, outwardly flaring side wall the upper portion of which is integrally joined to an annular top. The cover top has a plurality of combination ventilation and finger holes. The cover is also provided with a lower arcuate locking rim provided with a plurality of cut-away portions to allow the rim to expand in diameter when it is locked over the periphery of a circular plate. The cut-away portions of the locking rim also expose portions of the plate rim to permit manually restraining the plate when the cover is being removed from the plate.

2 Claims, 3 Drawing Figures

FIG. 1
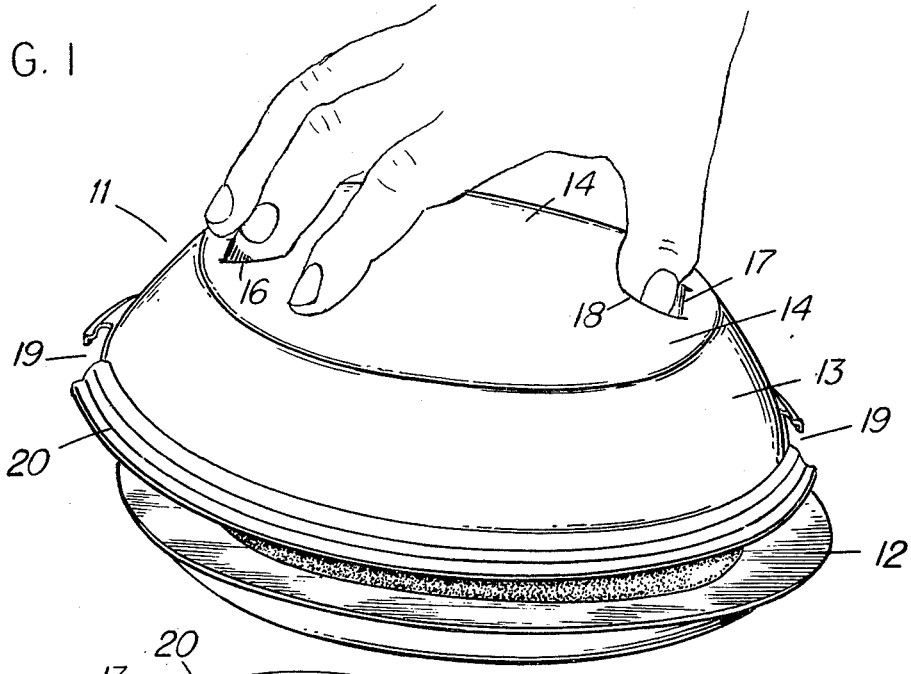
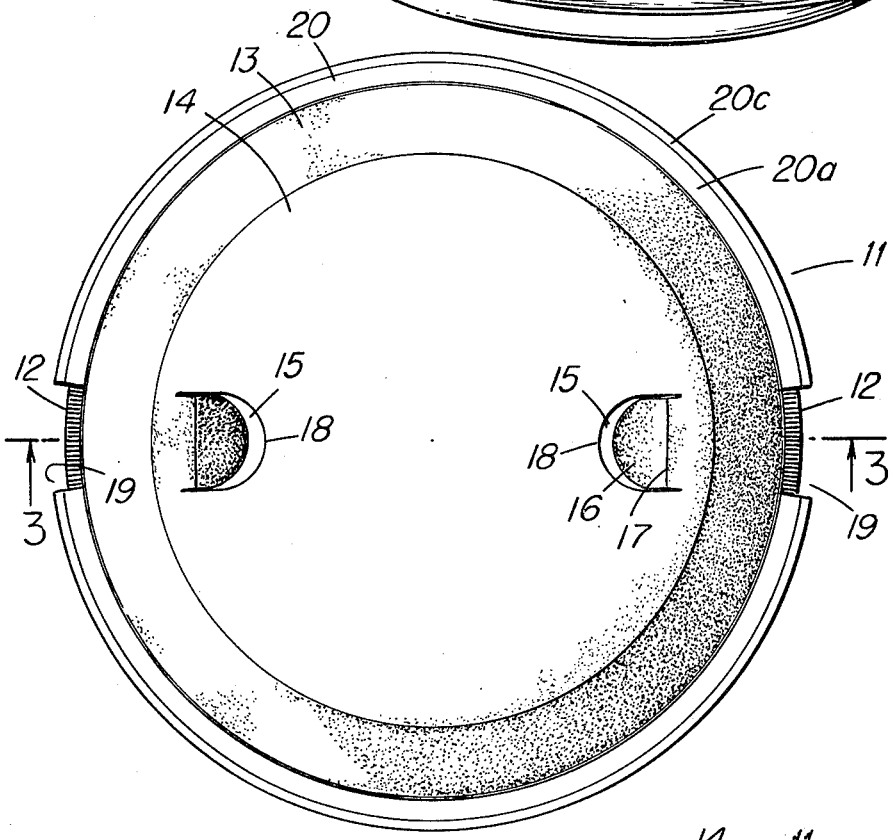
FIG. 2
FIG. 3
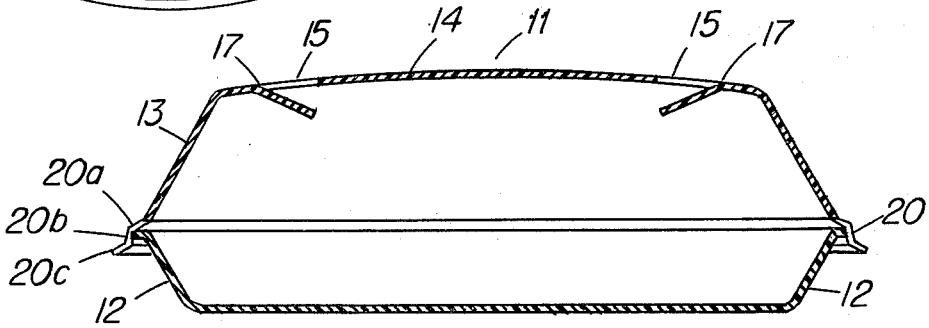

COVERED CONTAINER FOR SERVING FOOD WITH COMBINATION VENTILATION AND FINGER HOLES

BACKGROUND OF THE INVENTION

The present invention relates generally to covered containers of the type comprising plates or other dishes which have covers placed thereon for the purpose of keeping the food warm and sanitary.

Heretofore, combinations of this nature, which are used extensively in institutions, such as hospitals for serving patients, as well as in hotels and restaurants, have generally been made of metal and were intended to be washed and reused repeatedly.

SUMMARY OF THE INVENTION

It is a primary object of the present invention to provide a novel dish and cover assembly for serving food in which the cover and preferably also the dish can be produced so economically, while having the requisite strength and pleasing appearance, that they may be discarded after a single use.

In keeping with these objectives, the cover of the present invention is formed of thin gauge, i.e., on the order of from about 10 mils to about 125 mils and preferably about 90 mils, for polystyrene foam and about 12 mils for unfoamed plastic. The plastic cover may be fabricated from clear, transparent plastic or the plastic may be pigmented or in the form of a foam structure such as foam polystyrene. The cover which is generally dome shaped has an inwardly and upwardly inclined annular side wall.

An arcuate rim at the lower periphery of the cover is designed to lockingly engage the periphery of a plate such as a dinner plate. The rim is interrupted by cut-away portions or spaces in at least one area and preferably more to allow for outward flexure of the rim as it is snapped over the periphery of a plate. Such outward flexure of the rim results in a temporary increase in its diameter to facilitate its locking engagement with, and subsequent removal from, the periphery of the plate.

The annular top wall of the cover member is provided with at least one, and preferably more, apertures each of which have their own individual hinged closure. These apertures may serve a twofold function. If the cover is positioned over hot foods, the apertures may be opened by depressing the aperture closure downwardly and the apertures provide vent openings to allow for the escape of steam and vapors which would otherwise undesirably condense on the inner surface of the cover or cause the contained food to become soggy. Additionally, the apertures provide a finger opening for grasping the top of the cover when it is desired to remove the cover from its plate member. The aforedescribed cut-away spaces in the lower locking rim of the cover also assist in cover removal since they expose an area of the plate periphery whereby the plate may be manually depressed with the fingers of one hand while the other hand may grasp the cover through the apertures in the cover top and remove the cover.

BRIEF DESCRIPTION OF THE DRAWINGS

FIG. 1 is a perspective view of the cover member, and an associated dish, in accord with the present invention.

FIG. 2 is a top planar view of the cover shown in FIG. 1 which has been placed over a dish member.

FIG. 3 is a cross sectional view taken along line 3—3 of FIG. 2.

DESCRIPTION OF SPECIFIC EMBODIMENTS

Reference numeral 11 generally designates a dome shaped plastic cover of a specific embodiment of the invention which fits onto a food serving dish 12 which in the illustrated embodiment is a dinner plate. The cover has an annular side wall 13 which slopes upwardly and inwardly at an angle from the vertical of about 30°. The cover top wall 14 is essentially planar or may be slightly bowed upwardly as shown. Apertures 15 are provided in cover top 14 near the edge thereof and spaced apart about 180°. Apertures 15 are closed until ready for use by closure flaps 16 which are hinged at their base 17 to the cover top 14. Apertures 15 and their associated closure flaps 16 may be formed by making a radial cut 18 in the cover top 14 and forming a hinge 17 along the base of the radial cut by compressing the plastic along hinge line 17. Instead of a radial cut, perforations (not shown) may be employed to hold flap 16 in closed position until it is depressed. When it is desired to open flaps 16 downwardly directed digital pressure may be applied against flap 16 to cause it to rotate downwardly around integral hinge 17. When pressure is released, the flap 16 will remain in a downwardly depending position creating aperture 15. As hereinabove discussed, apertures 15 provide vent openings to allow for the escape of hot vapors such as steam which may be given off when hot food items are enclosed by the covers of the present invention.

As shown in FIG. 2, cover 11 is provided with an arcuate rim 20 around its lower periphery. Rim 20 is designed to lockingly engage the periphery of a food serving and support member, such as plate 12 shown in the accompanying drawings. Rim 20 comprises three distinct, but integrally joined in a continuous fashion, wall sections **20*a*, 20*b* and 20*c*. Side wall 13 is inclined at an angle from the vertical of about 30°. Wall section 20*a* of rim 20 forms an angle of about 60° with respect to the vertical; wall section 20*b* is perpendicular with respect to a horizontal plane; and wall section 20*c* forms an angle of about 45° with the vertical. As shown in FIG. 3 the outer upper edge of plate member 12 rests against the inner surface of wall section 20*a* while the peripheral edge of plate 12 bears against the inside surface of wall section 20*b*. It has been found that such an arrangement of the annular wall sections 20*a*, 20*b* and 20*c* of rim member 20 provides for secure locking engagement when the cover 11 is placed over an object such as plate member 12**.

In a particular embodiment of the cover structures of the present invention, it has been found that if wall section **20*a* of rim 20 has an inside surface which is angled with respect to the vertical approximately 10° less than its outside surface a more secure locking engagement of rim 20 with the rim of plate member 12 results. Specifically, the inside surface of wall section 20*a*** may form an angle of about 37.5° with the vertical while the outside surface may form an angle of about 47.5° with the vertical to form a secure lock even often repeated use.

As shown in FIG. 2 rim 20 may be provided with one or more interruptions (or cut-away areas) to form notches such as 19. Such interruptions in rim 20 perform a three-fold function. The interruptions or notches 19 allow for the temporary expansion of the diameter of rim 20 as it is positioned over and onto the rim of plate member 12. This facilitates the ease with which cover 11 may be placed in locking engagement with plate member 12. Likewise, rim notches 19 allow for outward flexure of rim 20 when cover 11 is removed from plate 12 to facilitate ease of removal. Finally, as will be seen from FIG. 2, rim notches 19 expose portions of the rim area of plate 12 which is otherwise completely covered by cover 11. Such localized exposure of the plate rim allows for ease of cover removal. Cover 11 may be grasped with the fingers through apertures 15. Plate 12 may be restrained while cover 11 is disengaged by grasping or holding down the plate rim which is exposed at rim notches 19.

A variety of forming techniques may be employed to form the cover structures of the present invention including injection molding. However, it has been found that when the covers are to be fabricated from plastic material such as polystyrene film or polystyrene foam, a thermoforming operation is the preferred manufacturing technique.

It is contemplated that the dish or plate 12 with which cover 11 is associated may also be disposable and made of an economic material such as paper or plastic. For example, a dinner plate is preferably made of a synthetic plastic material so that it is disposable after use. If desired, the plate may be compartmented, for example into three compartments comprising one large compartment for the main entree and two small compartments for vegetables or other food. A suitable plate may be made from a thermoplastic such as polystyrene foam, with or without other plastic layers adhered to the foam layer. By way of further example, and not by way of limitation, the plate may have a downturned peripheral rim comprised of compressed foam with the degree of compression increasing in the direction of the rim. One such plate is disclosed and claimed in U.S. Pat. No. 3,684,633 which is assigned to the assignee of the present invention.

While a presently-preferred embodiment of the invention has been shown and described with particularity, it will be appreciated that various changes and modifications may suggest themselves to those of ordinary skill in the art upon being appraised of the present invention. It is intended to encompass all such changes and modifications that fall within the scope and spirit of the appended claims.

What is claimed is:

1. A plastic container cover for use in serving food comprising a generally planar, circular top wall, an outwardly flaring, downwardly depending annular side wall having an arcuate rim integrally joined around its lower periphery, said top wall being characterized by having a plurality of apertures therein, each of said apertures having an associated closure member formed from a portion of said top wall, said arcuate rim being adapted to lockingly engage the periphery of a dish member, said arcuate rim being further characterized as discontinuous and radially expandable, having at least one notch therein.

2. In a container for use in serving food and having a dish for holding food the improvement comprising a plastic cover disposed on said dish said cover having a lower rim which lockingly engages the periphery of said dish, said rim having at least one notch therein whereby a portion of the periphery of said dish is exposed, said cover having a generally circular top wall, said top wall having a plurality of apertures therein, each of said apertures having an associated closure member hingedly connected to said top wall, said rim being further characterized as being radially expandable.

* * * * *